US007785461B2

(12) United States Patent
De Almeida et al.

(10) Patent No.: US 7,785,461 B2
(45) **Date of Patent: *Aug. 31, 2010**

(54) PROCESS FOR SELECTIVE HYDRODESULFURIZATION OF NAPHTHA

(75) Inventors: Rafael Menegassi De Almeida, Rio de Janeiro (BR); Jefferson Roberto Gomes, Rio de Janeiro (BR); Marcelo Edral Pacheco, Rio de Janeiro (BR); Marcus Vinicius Eiffle Duarte, Rio de Janeiro (BR); Rogerio Oddone, Rio de Janeiro (BR); Giane Ribeiro Stuart, Rio de Janeiro (BR)

(73) Assignee: Petroleo Brasileiro S.A. - Petrobras, Rio de Janeiro (BR)

( * ) Notice: Subject to any disclaimer, the term of this patent is extended or adjusted under 35 U.S.C. 154(b) by 436 days.

This patent is subject to a terminal disclaimer.

(21) Appl. No.: 11/099,476

(22) Filed: Apr. 6, 2005

(65) Prior Publication Data

US 2006/0096893 A1 May 11, 2006

(30) Foreign Application Priority Data

Nov. 10, 2004 (BR) ..... 0404951

(51) Int. Cl.
*C10G 65/04* (2006.01)

(52) U.S. Cl. ..... 208/210; 208/216; 208/216 PP; 208/216 R; 208/217; 208/220; 208/306

(58) Field of Classification Search ..... 208/210, 208/216, 217, 306, 216 PP, 216 R, 220
See application file for complete search history.

(56) References Cited

U.S. PATENT DOCUMENTS 2,061,845 A 11/1936 Morrell 2,070,295 A 2/1937 Morrell (Continued)

FOREIGN PATENT DOCUMENTS

BR 0202413-6 5/2004

(Continued)

OTHER PUBLICATIONS

Jaffe, "Kinetics of Heat Release in Petroleum Hydrogenation," Ind. Eng. Chem., Process Des. Develop., vol. 13, No. 1, 1974. pp. 34-39.

*Primary Examiner*—Glenn Caldarola
*Assistant Examiner*—Prem C. Singh
(74) *Attorney, Agent, or Firm*—Sughrue Mion, PLLC

(57) ABSTRACT

A process for the selective hydrodesulfurization of a naphtha containing olefins and organosulfur compounds is disclosed, which minimizes the hydrogenation of the olefins and results in a product with a low sulfur content. The process involves a two-stage hydrodesulfurization with $H_2S$ removed from the first stage effluent. A flow of hydrogen and at least one added non-reactive compound is fed into the first stage, wherein the $H_2$ molar fraction ranges from 0.2 to 1.0, and with $H_2S$ at the reactor intake limited to a maximum of 0.1% by volume. The second stage involves a feedstream of hydrogen and at least one added non-reactive compound, wherein the $H_2$ molar fraction ranges from 0.2 to 0.7 and with $H_2S$ at the reactor intake limited to a maximum of 0.05% by volume.

29 Claims, 2 Drawing Sheets

U.S. PATENT DOCUMENTS

| | | | | |
|---|---|---|---|---|
| 2,793,170 | A | 5/1957 | Stiles et al. | |
| 3,349,027 | A | 10/1967 | Carr et al. | |
| 3,732,155 | A | 5/1973 | Cecil et al. | |
| 3,957,625 | A | 5/1976 | Orkin | |
| 4,334,982 | A | 6/1982 | Jacquin et al. | |
| 4,397,739 | A | 8/1983 | Jacquin et al. | |
| 5,348,928 | A * | 9/1994 | Kukes et al. | 502/306 |
| 5,906,730 | A | 5/1999 | Hatanaka et al. | |
| 6,126,814 | A | 10/2000 | Lapinski et al. | |
| 6,231,753 | B1 | 5/2001 | McKnight et al. | |
| 6,429,170 | B1 | 8/2002 | Dodwell | |
| 6,482,314 | B1 | 11/2002 | Khare | |
| 6,736,962 | B1 | 5/2004 | Cook et al. | |
| 6,893,554 | B2 * | 5/2005 | Brignac et al. | 208/217 |
| 2003/0042175 | A1 | 3/2003 | Debuisschert et al. | |
| 2003/0209467 | A1 | 11/2003 | Didillon et al. | |
| 2003/0217951 | A1 | 11/2003 | Marchal-George et al. | |
| 2003/0232723 | A1 | 12/2003 | Dodwell et al. | |
| 2004/0000507 | A1 | 1/2004 | De Almeida et al. | |

FOREIGN PATENT DOCUMENTS

| | | | |
|---|---|---|---|
| WO | WO 03/085068 | A1 | 10/2003 |
| WO | WO 2004/003112 | A1 | 1/2004 |

* cited by examiner

PROCESS FOR SELECTIVE HYDRODESULFURIZATION OF NAPHTHA

FIELD OF THE INVENTION

The present invention relates to a process for the selective hydrodesulfurization of a naphtha flow containing organosulfur compounds and olefins. More particularly, the process comprises two reaction stages wherein the naphtha charge contacts a flow of hydrogen and at least one added non-reactive compound and $H_2S$ is removed from the effluent of the first reaction stage.

BACKGROUND OF THE INVENTION

Present and future automotive fuel specifications point to a significant reduction in sulfur content, mainly in gasoline, with the principal source of organosulfur compounds being fluidized catalytic cracking naphthas (FCC naphthas). FCC naphthas typically have a sulfur content ranging from 1,000 to 1,500 mg/kg. In addition to organosulfurized compounds, FCC naphthas typically have an olefin content from 25-35% by mass.

Conventional hydrodesulfurization (HDS) fixed-bed processes render reduction of the sulfur content in FCC naphtha flows feasible, although the olefins are hydrogenated to some degree, resulting in an unwanted decrease in the octane rating for a gasoline compound containing a hydrodesulfurized flow of an FCC naphtha.

Accordingly, there is a high demand for maintaining the octane rating of gasoline, and thus for sulfur-reduction processes that preserve naphtha olefins. Various processes for the selective hydrodesulfurization of olefinic naphthas are known, wherein selectivity is understood to be reduction of sulfur content while preserving the olefins.

For example, an olefinic naphtha can initially be separated into two distillation fractions so that only the heavy fraction can be subjected to a hydrodesulfurization reaction. Following the reaction, both fractions are restored, and the olefins in the light olefinic fraction can be preserved. This method provides gasoline with a reduced sulfur content while preserving its octane rating. U.S. Pat. Nos. 2,070,295, 3,957,625 and 4,397,739 disclose this type of processing, though with some sulfur remaining in the light naphtha. U.S. patent application 2003/0042175 discloses a process with an additional stage for alkylating thiophenic sulfur in the light naphtha in order to concentrate the sulfur in the heavy naphtha.

U.S. Pat. Nos. 3,957,625, 4,334,982, and 6,126,814 disclose catalytic formulations whose catalyzing characteristics selectively favor hydrodesulfurization while reducing olefin hydrogenation.

Preferably, as the usual hydrorefining catalysts, HDS processes involving olefinic naphthas use catalysts based on transition metal-oxides from Group VI B, preferably $MoO_3$, and transition metal oxides from Group VIII, preferably CoO, in the form of sulfides, supported on an appropriate porous solid. Supports preferably have their acidity reduced by using additives, or else their composition is of intrinsic low acidity. Variations in the metal content are also known, with optimum relationships among them.

U.S. Pat. No. 2,793,170 discloses that low pressures favor a lesser degree of olefin hydrogenation without hindering hydrodesulfurization. The foregoing patent also discloses that, in addition to reactions whereby organosulfur compounds are converted, there is also a reaction recombining the $H_2S$ produced by the reactions with the remaining olefins, forming mercaptan compounds. Such reaction makes it difficult to obtain sufficiently low sulfur content in the product without triggering extensive hydrogenation of the olefins. High temperatures also hinder the reaction whereby olefins are recombined with $H_2S$.

The inventor's patent application BR-0202413-6, corresponding to published U.S. application 2004/0000507, discloses using a mixture of at least one added non-reactive compound with hydrogen to trigger selective hydrodesulfurization of a charge of cracked olefin flows. The mixture increases dilution of the hydrogen in the reaction and minimizes olefin hydrogenation without significantly decreasing the conversion of organosulfur compounds. In addition, the mixture decreases the concentration of $H_2S$ generated in the reaction and minimizes recombination. It can be seen that a higher ratio of gas per charge volume indicates a decrease in the sulfur content of the product. As to the added non-reactive compounds, it can also be seen that the desired effect of the increased selectivity is achieved not only with nitrogen but also with various diluting compounds and mixtures thereof. It can further be seen that a drop in total pressure does not lead to the same reaction selectivity obtained by using at least one added non-reactive compound. It reduces olefin conversion but increases the sulfur content of the product.

Patent application WO 03/085068 discloses a selected hydrodesulfurization process wherein a mixed charge of naphtha flows with an olefin content of greater than 5% m/m reacts under normal hydrodesulfurization conditions while contacting a selective catalyst. ("m/m" means mass percentage) The process is intended to reduce the sulfur content by more than 90% and to hydrogenate less than 60% of the olefins in the charge. Octane rating loss is expected to be greater from separately treated flows than from naphthas treated as a mixture. Co-processing of a mixture of an olefinic naphtha flow with a non-olefinic naphtha in an amount ranging from 10% to 80% by mass results in at least a 0.1 increase in the octane rating of the final product in comparison to the product processed separately in two charges. Other than a non-olefinic naphtha, no other component is considered for the olefinic naphtha mixture. Further, since naphthas usually have similar distillation temperature ranges, the non-olefinic naphtha will form part of the final gasoline formulation, thereby limiting the application of co-processing.

U.S. Pat. Nos. 6,429,170 and 6,482,314 disclose a process for removing sulfur from catalytic cracking naphtha in a single reaction stage. The process uses a partially sulfided Ni- or Co-based regeneratable reactive adsorbent on a ZnO support. The zinc oxide absorbs the $H_2S$ resulting from conversion of the organosulfurized compounds, preventing the recombination reaction, thereby resulting in process selectivity. U.S. patent application 2003/0232723 uses nitrogen in the adsorption process with a regeneratable reactive adsorbent to boost selectivity, wherein the hydrogen molar fraction in the mixture ($H_2$+$N_2$) must be greater than 0.8.

In addition to the single-stage processes described above, and also in order to suppress the recombination reactions, hydrodesulfurization processes have been applied to more than one reaction stage, in which the $H_2S$ generated in the reaction is removed between the stages.

U.S. Pat. No. 2,061,845 discloses the use of more than one reaction stage with $H_2S$ removed between the stages in the hydrotreatment of cracked gasolines, leading to lesser hydrogenation of olefins and a lower octane rating decrease in comparison to single-stage hydrotreatment. U.S. Pat. No. 3,732,155 discloses the use of two stages with $H_2S$ removed between them, and without the charge contacting hydrogen in the second reaction stage.

U.S. Pat. No. 3,349,027 discloses hydrotreatment of olefinic naphthas in two stages, with an intermediate removal of $H_2S$ and with a high space velocity (LHSV), making it possible to remove virtually all the mercaptans. Results suggest that the mercaptan reaction rate is rather high, quickly achieving a balance between the olefins present and the $H_2S$ in the product.

U.S. Pat. No. 5,906,730 discloses a hydrodesulfurization process for a cracked naphtha in two or more reaction stages, with 60-90% of the sulfur in the charge of each stage removed, allowing for total removal of up to 99% of the sulfur in the original naphtha and with less conversion of olefins in comparison to just one reaction stage.

The $H_2S$ generated in each reaction stage is removed before the subsequent stage so as to hinder mercaptan formation resulting from recombination of $H_2S$ with the remaining olefins. In U.S. Pat. No. 5,906,730 the operation of the two reaction stages is claimed for specific hydrogen partial pressures between 0.5 to 3.0 MPag in the first stage and 0.5 to 1.5 MPag in the second stage. The claimed hydrogen partial pressure conditions are met under overall pressure conditions and hydrogen flow rates typical for HDS of cracked naphtha. There is no description nor suggestion of any added non-reactive compounds to the hydrodesulfurization reaction aiming at reducing olefin hydrogenation.

U.S. Pat. No. 6,231,753 discloses a hydrodesulfurization process with two reaction stages, with more than 70% of the sulfur removed in the first stage and 80% of the remaining sulfur removed in the second stage, leading to a total removal of more than 95% of the charge sulfur. Between two reaction stages $H_2S$ is removed. In order to obtain better selectivity (olefin retention) as compared to previously described two-stage processes, this patent claims a second stage where the temperature and LHSV are higher than those in the first stage: temperature 10° C. higher and LHSV at least 1.5 times higher.

U.S. Pat. No. 6,231,753, reporting the state-of-the-art, teaches that hydrorefining units make use of non-reacted hydrogen for carrying out the reaction and that the consumed hydrogen should be replenished. The same patent further teaches that such hydrogen make-up streams comprise more than 60% by volume hydrogen, and preferably more than 80% by volume, the remaining being inert compounds such as $N_2$, methane and the like.

The so-called inert compounds that may constitute part of the make-up hydrogen result from hydrogen preparation processes. The presence and concentration of so-called inert compounds depend on the presence or not as well as on the efficiency of the $H_2$ purification units. Hydrogen is typically produced in units such as steam reform or as by-product from naphtha catalytic reform. Previously to purification processes, the hydrogen stream from the catalytic reform contains methane and light hydrocarbons, while that from steam reform of natural gas can contain $N_2$. Natural gas used as reform feed can also contain $N_2$ in amounts lower than 10% by volume. Cryogenic processes, membrane separation and molecular sieve adsorption—PSA (Pressure Swing Adsorption) are the most widely used techniques for the purification of such streams. In the technique, inert compounds are considered as undesirable contaminants, so that usually high-purity make-up hydrogen is employed so as to avoid collection of such inert compounds in the gas recycle of hydrorefining units.

U.S. Pat. No. 6,231,753 does not consider the addition of non-reactive or inert compounds as a means for minimizing olefin hydrogenation. On the contrary, said patent teaches that make-up hydrogen is preferably a high-purity stream. In the case the make-up hydrogen stream contains inert compounds, the amount of such compounds in the reaction medium will depend on (i) the recycle flow rate in the system, (ii) the hydrogen consumption, (iii) the make-up flow rate, (iv) the equilibrium in the separator vessels and (v) the presence or not of further treatment of the recycle gas for $H_2S$ withdrawal, which can also remove some of the inert compounds.

U.S. patent application 2003/0217951 discloses two reaction stages with $H_2S$ removed between them. This process differs from those in the previously cited patents in that more than 90% of the sulfur is converted in the first stage and the reaction rate in the second stage is slower than that in the first stage. A slower reaction rate can be obtained at a temperature lower than that in the first stage.

U.S. Pat. No. 6,736,962 discloses a two-stage process for removing sulfur, with an intermediate $H_2S$ removal step between them. A previously hydrodesulfurized olefinic naphtha, containing less than 30 mg/kg of non-mercaptan sulfurized compounds, is processed while contacting a catalyst together with a purge gas, under two possible conditions. When the purge gas is hydrogen, the second-stage catalyst is an irreducible oxide (merely a support, with no hydrogenating activity). When the purge gas is a gas compound, such as He, $N_2$, Ar, $CH_4$, natural gas, light gas, and mixtures of the same containing no hydrogen, the second-stage catalyst is an oxide of a metal from Group VIIIB enhanced by an oxide of a metal from the supported Group VIB (hydrorefining catalyst). The invention does not contemplate mixtures of a purge gas and hydrogen.

Typical conditions for each reaction stage in HDS processes are: pressures ranging from 0.5 to 4.0 MPaG, preferably from 2.0 to 3.0 MPaG; temperatures ranging from 200 to 400° C., preferably from 260 to 340° C.; space velocity (volume processed per hour per volume of catalyst), or SV, from 1 to 10 $h^{-1}$; rate of hydrogen volume per processed charge volume ranging from 35 to 720 $Nm^3/m^3$; and hydrogen purity normally higher than 80%, and preferably higher than 90%. ("$Nm^3/m^3$" as a unit for rate of hydrogen volume per processed charge volume means $m^3$ of gas at normal conditions (1 bar, 0° C.) per $m^3$ of feedstock.)

Literature also indicates that when $H_2S$ is removed between reaction stages, the $H_2S$ concentration at the second stage intake should preferably be less than 0.05% by volume (500 ppmv), or more preferably, the $H_2S$ concentration in the gas produced by the second reactor should be less than 0.05% by volume so that it may be recycled back to the first reactor untreated.

Multiple processes are also seen in the art, indicative of the importance and the difficulties inherent to selective processes for removing sulfur from olefinic naphtha flows.

Accordingly, there is still a need for a catalytic hydrodesulfurization process capable of reducing the sulfur content in FCC naphtha charges to the maximum, with minimum hydrogenation of olefins. These objectives have been achieved in the process of the present invention.

SUMMARY OF THE INVENTION

The present invention relates to a process for the selective hydrodesulfurization of a naphtha flow containing organosulfurized compounds and olefins, which reduces the sulfur content while minimizing hydrogenation of the olefins found in the charge.

The process comprises a two-stage catalytic hydrodesulfurization reaction whereby the naphtha charge contacts a flow of hydrogen and at least one added non-reactive compound, with $H_2S$ removed from the effluent from the first reaction stage.

In an initial reaction stage, under hydrodesulfurization conditions in a reactor charged with a hydrorefining catalyst, a charge of naphtha contacts a flow of hydrogen and at least one added non-reactive compound wherein the $H_2$ molar fraction ranges from 0.2 to 1, and with the $H_2S$ concentration at the reactor intake limited to not more than 0.1% by volume. Effluent from the first stage of the reaction is then subjected to a step for removing the $H_2S$. Next, the partially hydrodesulfurized naphtha is piped to a second reaction stage in a reactor charged with a second hydrorefining catalyst, under second hydrodesulfurization conditions, where it contacts a flow of hydrogen and at least one added non-reactive compound wherein the $H_2$ molar fraction ranges from 0.2 to 0.7, and with the $H_2S$ concentration at the reactor intake limited to not more than 0.05% by volume in order to recover a hydrodesulfurized naphtha, the selectivity of which is improved as compared to state-of-the-art processes.

The hydrodesulfurization process of the present invention preserves the olefins while producing hydrodesulfurized olefinic naphthas, advantageously by using at least one added non-reactive compound mixed with hydrogen and under optimized hydrodesulfurization reaction conditions during both stages or alternatively during the second stage only.

DETAILED DESCRIPTION OF THE INVENTION

Figure 1:
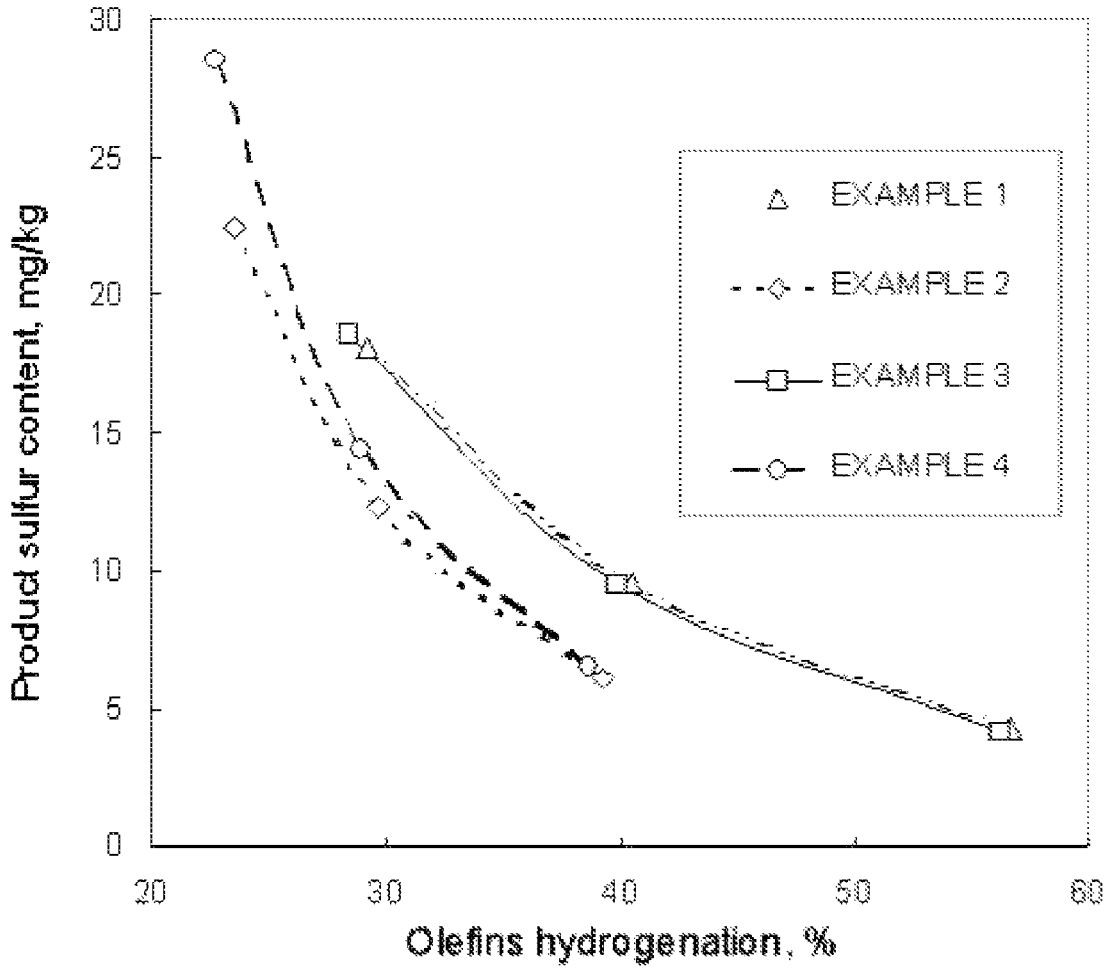
FIG. 1 illustrates the effects of nitrogen on the hydrodesulfurization and hydrogenation of olefins in a naphtha charge, for both the first and second stages of the reaction, in accordance with EXAMPLES 1 to 4, wherein $H_2S$ was removed between the two stages.

The present invention relates to a catalytic hydrodesulfurization process in two reaction stages involving a charge of a naphtha containing olefins and organosulfurized compounds with a flow comprising a mixture of hydrogen and at least one added non-reactive compound. The $H_2S$ is removed from the effluent in the first reaction-stage and a hydrodesulfurized olefinic naphtha is recovered wherein the sulfur content has been reduced by more than 90% by mass and the olefins in the charge have been hydrogenated to a maximum of 40% by mass.

Olefinic naphthas containing organosulfur compounds that can be applied to the process of the present invention include, but are not limited to catalytic cracking naphthas; fractionated catalytic cracking naphthas, the light or heavy fractions thereof and narrow fractions; naphthas and their fractions, previously hydrogenated to remove dienes; and naphthas from delayed coking, etc.

Typical charges for the process of the present invention include olefinic naphthas having an olefin concentration ranging from 20% to 50 mass % and a sulfur concentration ranging from 300 to 7,000 mg/kg. Naphthas obtained from catalytic cracking units frequently contain an olefin concentration ranging from 25% to 35 mass % and a sulfur concentration from 1,000 to 1,500 mg/kg.

Olefinic naphthas may also contain dienes, which is undesirable for a process if dienes are present at a high concentration (exceeding 1.0 g $I_2$/100 g). In this case, the charge must be pretreated by selective hydrogenation under conditions of low severity in order to hydrogenate only the dienes and thus prevent coke from forming in heat exchangers and furnaces upstream from the first-stage reactor of the hydrodesulfurization reaction, or at the top of the reactor. ("g$I_2$/100 g", the iodine number, is a measurement of the diene value of naphtha, according to UOP 326-82 test, "Diene value by maleic anhydride addition reaction.")

The present invention comprises a two-stage reaction, conducted under usual hydrodesulfurization conditions and at the usual volumetric rates, or lower rates, for hydrogen with regard to the charge. At least one added non-reactive compound is mixed with the hydrogen to constitute a flow admitted into the reactor preferably at a temperature higher than the dew point of the mixture.

Added non-reactive compounds useful for the process of the present invention are selected from the group consisting of nitrogen, noble gases, saturated hydrocarbons (from C1 to C4), and mixtures thereof.

For the purposes of the invention, the added non-reactive compounds should be made up of at least 90% by volume of non-reactive compounds under the hydrodesulfurization process conditions. Further, the sulfur content of such non-reactive compounds is lower than 500 ppm and their olefin content is lower than 10% by weight.

At each stage of hydrodesulfurization, a usual hydrorefining catalyst is used. For purposes of the present invention, hydrorefining catalysts are those comprised of oxides of the Group VIB and/or VIII metals supported on an appropriate porous solid. Sulfided catalysts comprising of a mixture of oxides of a Group VIII metal of Ni or Co, and a Group VIB metal of Mo or W, prior to sulfiding, may be employed in the invention. Catalysts containing CoO and $MoO_3$ offer a better desulfurizing capacity than those containing NiO and $MoO_3$, resulting in less olefinic hydrogenation for the same degree of hydrodesulfurization. The oxides are supported on a porous solid. Non-limiting examples of a porous solid are alumina, silica, zeolites, titanium, carbon, aluminum phosphate, zinc oxide, and diatomaceous earth. The oxides are preferably supported on alumina or supports of low acidity. The intrinsic acidity of a catalyst support can be reduced, either by using mixed oxides such as $Al_2O_3$ and MgO as a support, or by depositing Group I alkaline metal compounds and/or Group II alkaline-earth metal compounds on the support. In addition to the basic oxide MgO, pure or mixed with $Al_2O_3$, basic oxides such as CaO, BeO, BaO, SrO, $La_2O_3$, $CeO_2$, $Pr_2O_3$, $Nd_2O_3$, $SmO_2$, $K_2O$, $Cs_2O$, $Rb_2O$, or $ZrO_2$, pure or mixed with alumina, can be used. The use of a mixture of various hydrorefining catalysts can also be considered in the hydrodesulfurization reactors, as well as catalysts deactivated by having been previously used in another hydrorefining unit.

The content of Group VIB and of the Group VIII metals as oxides in the catalytic support is generally in the range of 5 to 30% by mass.

The catalysts herein described can be used in both reaction stages. Each reaction stage can comprise one or more hydrorefining reactor, and each reactor can comprise one or more reaction sections. Each reaction section can comprise a different catalyst. Hydrogen alone or hydrogen admixed to the at least one added non-reactive compound or the at least one non-reactive compound alone is added between stages. Besides the addition of a gas stream, a portion of the charge or of the products can be added between reaction stages. Such addition of streams between reaction stages aims at reducing reaction temperature before the mixture attains the next reactor section. It is well known that the hydrogenation reaction is exothermic. If the product temperature is not carefully controlled, olefin hydrogenation can be extensive and hot spots are formed in the reactor. Preferably, the presence of added non-reactive compounds inhibits olefin hydrogenation and accommodates the reaction heat, so that temperature increase is limited. According to a preferred condition of the invention, the injection of a stream designed to take heat between reactor sections is dispensed with.

According to the invention, each reactor section can contain a different hydrorefining catalyst, among those described hereinbefore.

Also, each reaction stage can contain the same catalyst as the other stage. Alternatively, the reaction stages each contain a different catalyst.

The preferred catalyst includes usual hydrorefining catalysts, such as a sulfided, alumina-supported CoMo catalyst.

The following are normal hydrodesulfurization conditions: temperature ranging from 200 to 420° C.; pressure from 0.5 to 5.0 MPaG; and LHSV from 1 to 20 $h^{-1}$.

High temperatures improve hydrodesulfurization efficiency by hindering the reaction whereby $H_2S$ recombines with the remaining olefins. However, very high temperatures (greater than 420° C.) may cause the catalyst to deactivate rapidly. In the present invention, the average desired temperature range in the reactive medium is from 200 to 420° C., preferably from 240 to 380° C., and more preferably from 260 to 320° C.

The heat released during olefin hydrogenation is undesirable with this process, because it causes the reactor temperature to rise. Depending on the amount of heat released, more than one catalyst bed may be needed, along with injection of hydrogen or a flow of hydrogen and at least one added non-reactive compound, at a lower temperature between the two beds so as to reduce the temperature of the naphtha flow prior to reaching the next bed. Should both beds be necessary, they can also be separated in more than one reactor.

Preferably, process conditions are optimized in order to reduce olefin hydrogenation, consequently releasing less heat. Advantageously, this result is obtained by the presence of at least one added non-reactive compound that inhibits olefin hydrogenation and is also able to accommodate the heat generated in the reactive medium.

The higher the pressure, the greater the olefin hydrogenation, thus making the process less selective. At the same time, very low pressures (less than 1.0 MPaG), lead to reduced conversion of organosulfur compounds even if said stream of at least one non-reactive compound and hydrogen added to naphtha contains pure hydrogen (small amount or no added non-reactive compound). Thus, the pressure in the hydrodesulfurization reactors is preferably between 1.0 and 3.0 MPaG, and more preferably, between 1.5 and 2.5 MPaG.

The combination of the addition of at least one non-reactive compound with the HDS in two stages and $H_2S$ removal can be performed according to different modes. Thus, the addition of the at least one non-reactive compound can be carried out in both stages, in the first stage or in the second stage.

It could be expected that the mere addition of at least one non-reactive compound in one or both stages of the state-of-the-art HDS naphtha two-stage process, would result in selectivity improvement. However, the following Examples illustrate that the addition of at least one non-reactive compound or inert compound in the first stage leads to the same or lower selectivity than the two-stage state-of-the-art, without any advantage or process improvement.

On the contrary, the addition of at least one non-reactive compound in both stages or in the second, final stage only shows significant improvements as compared to the state-of-the-art.

Unexpectedly, the addition of at least one non-reactive compound in the second or final stage only shows an improvement as compared to the addition of the at least one non-reactive compound in both reaction stages.

Without willing to limit the scope of the present invention, the selectivity improvements obtained in the HDS process can be explained on the grounds of the following considerations.

The limitation of the $H_2S$ at the intake of each reaction stage, and consequently, at the outlet, restricts the $H_2S$ recombination reaction with the remaining olefins, so as to reduce the sulfur content in the product. The selectivity improvement is reached through (i) reduction of the $H_2S$ content at the intake of each reactor or reaction stage, this being reached by removing $H_2S$ in the hydrogen and at least one non-reactive compound stream that is contacted with the olefinic charge, and (ii) separation of one reaction stage into two reaction stages, plus the removal of intermediate $H_2S$.

Working with more reaction stages and removing $H_2S$ before the subsequent stage could lead to maximum reduction in the undesirable recombination reaction. However, the use of more than two reaction stages is not industrially practical. At the end of each reaction stage there is always a $H_2S$ content resulting from the conversion of the charge sulfurized compounds, which necessarily leads to recombination.

It is believed that another way of reducing the recombination reaction besides the reduction in $H_2S$ content at the intake of each reaction stage is to reduce the $H_2S$ concentration through different techniques.

Alternative ways for such purpose are the reduction in overall pressure and the increase in the $H_2$/charge ratio.

Pressure reduction would lead to a lower $H_2S$ concentration. However, the conversion of thiophenic sulfur would also diminish (through diminishing of the sulfurized compound concentration, the hydrogen and the residence time in the reactor), this leading to lower total sulfur removal.

Further, the mere increase in the $H_2$/charge ratio results in lower sulfur in the end product, but by increasing hydrogen concentrations, olefin hydrogenation is correspondingly augmented.

On the other hand, the present invention, by combining the removal of a major portion of the formed $H_2S$ through separation into two stages, plus the addition of at least one non-reactive compound to replace $H_2$, makes possible to reduce the $H_2S$ concentration while at the same time olefin hydrogenation is diminished as a result of lower $H_2$ concentration.

As will be seen in the Examples below, it is possible to observe the increased HDS selectivity after the addition of the at least one non-reactive compound to both reaction stages.

Unexpectedly, in the light of the state-of-the-art knowledge, Example 3 of the application shows that the addition of at least one non-reactive compound in the first or initial reaction stage results in the same or lower selectivity than state-of-the-art processes (Example 1). In the same way, in Example 2 the addition of at least one non-reactive compound in the second or final reaction stage only showed improved selectivity as compared to the addition of such non-reactive compounds in both stages (Example 4). The characteristics of the sulfur compounds obtained in the first reaction stage for Examples 1 and 3 were analyzed. The temperature conditions of the tests for Examples 1 and 3 were varied so as to obtain the same sulfur content of the HDS product by using $H_2$ alone (Example 1) and $H_2$ plus at least one added non-reactive compound (Example 3). For HDS plus at least one added non-reactive compound the percentage of mercaptan compounds from recombination is lower than that from $H_2$ alone. It is well known that the conversion of mercaptan compounds does not involve any hydrogenation, while thiophenic sulfur removal is more hydrogen-dependent. It is also known that mercaptan compounds are more easily desulfurized than thiophene compounds.

Therefore, in the case of at least one added non-reactive compound plus hydrogen in the first stage only, the resulting more thiophenic sulfur is more hardly desulfurizable, and requires deeper severity in the second reaction stage. Thus the selectivity conquered in the fist stage through the use of at least one added non-reactive compound is lost in view of the need of a deeper severity in the second stage, using $H_2$ alone, this leading to a higher hydrogenation. Thus, the selectivity for this non-desired mode is the same or worse than the two stage HDS state of the art using $H_2$ alone.

In the case of the invention mode where both stages contain hydrogen plus at least one added non-reactive compound, in spite of the second stage charge being more thiophenic, the final HDS is also more selective even for deeper severity, the process being more selective than the state-of-the-art of two stages and $H_2$ alone.

As for the preferred mode of the invention with at least one added non-reactive compound in the final reaction stage, a fairly good sulfur conversion is obtained in the first stage with $H_2$ alone, olefin hydrogenation being not severe. Thus, it is possible to promote the final HDS at a still higher selectivity, resulting in the highest possible selectivity among the possible process set-ups ($H_2$+at least one added non-reactive compound in the first, in the second stage or in both stages).

The appended Examples show that the solution envisaged by the present invention for the problem of HDS selectivity, that is, a two-stage reaction, lower $H_2S$ concentration at the intake of each stage and the injection of at least one added non-reactive compound in both stages or in the final stage only led to improved selectivity as compared to state-of-the-art processes using $H_2$ alone or one stage employing $H_2$ plus at least one added non-reactive compound.

When the at least one non-reactive compound is added to both reaction stages, it is possible to operate with similar compositions of $H_2$ plus added non-reactive compounds, or alternatively, with different such compositions in each stage.

Based on the illustrative Examples, it is reasonable to assume that higher selectivity will be obtained through a higher $H_2$ molar ratio in the mixture of $H_2$ and at least one added non-reactive compound in the first reaction stage than in the second reaction stage. Further, the more advantageous selectivity condition will be provided by a lower $H_2$ molar ratio in the mixture of $H_2$ and at least one added non-reactive compound in the second reaction stage.

Typical ranges involve, for the first stage, the $H_2$ ratio between 0.2 and 1.0 and between 0.2 and 0.7 for the second stage. A preferred range is 1.0 for the first stage (hydrogen only) and between 0.3 and 0.6 for the second stage.

It should be borne in mind that the addition of non-reactive compounds, devoid of any added Hydrogen to a second treatment stage, is disclosed in the technique in a mode similar to that provided by the present invention. However, the portion of thiophene compounds from the first reaction stage will not be converted, so that the low sulfur contents and high selectivity obtained by the present process and illustrated by the Examples below will not be attained.

A further aspect relates to industrial process set-ups, which can be several.

The usual hydrorefining unit configuration involves the recycle of the non-reactive hydrogen downstream the high-pressure separator. To the hydrogen recycle is added the make-up hydrogen, so as to keep the unit pressure at the desired level, replenishing hydrogen consumed in the reactions and lost during $H_2S$ removal steps and dissolved in the liquid product (in the gas and liquid separators).

For two reaction stages, several set-ups are known, involving independent gas recycle in each stage or just one recycle, where the outlet gas of one reaction stage is fed to another stage. For independent recycles in each stage, the outlet gas of each stage is re-channeled, plus make-up hydrogen to the intake of such stage.

Depending on the $H_2S$ and sulfur contents of the charge of each reaction stage, $H_2S$ removal can be performed in several ways.

In the case of one single recycle, if the sulfur content of the second stage charge is small, $H_2S$ in the outlet gas of the second stage can be at such a low level that it does not cause any recombination drawback, and thus it can be directed straight to the first reaction stage. Since in the first reaction stage the sulfur content is higher, $H_2S$ should be removed from the gas and the liquid product to be directed to the second reaction stage.

Other variations known by the experts in the case of independent gas recycles would be simply one or two units for removing sulfur from gas. If the gas recycles are independent and the sulfur content in the second stage charge is small, the $H_2S$ reached in the recycle can be small and do not cause any recombination drawback, and only one $H_2S$ removal stage may be required in the second stage recycle gas.

Similar set-ups can be straightforward for the experts in order to promote the two-stage reactions in the presence of at least one added non-reactive compound, under the conditions claimed in the present invention. Besides the injection of make-up $H_2$, the at least one non-reactive compound, the amount of which can have been lost through solubility in the products or else during the sulfur removal steps should be replenished. Upon injection of streams of $H_2$ and at least one non-reactive compound, the maintenance of the desired conditions is obtained by keeping the unit pressure and the desired $H_2$ ratio in the mixture of $H_2$ and at least one added non-reactive compound.

Besides the separate injection of $H_2$ and at least one added non-reactive compound it is possible to add both compounds in one single stream or at least part of the added non-reactive compound together with the hydrogen.

Thus, some processes for producing $H_2$ lead to $H_2$ contaminated by so-called inert compounds such as $N_2$ or methane and ethane. However, the solubility losses of $H_2$ and such compounds are different, and it would not be possible control under arbitrary conditions the recycle compositions, such compositions depending on the degree of $H_2$ consumption and loss of non-reactive or inert compounds. Such practice is not desired, since the complete means for maintaining the operation conditions under desired parameters cannot be provided.

In the case of similar compositions of the mixture of $H_2$ and at least one added non-reactive compound in one reaction stage, the outlet gas of the first stage, if the non-reactive compound is non-condensable, after $H_2S$ removal from the effluent said gas can be fed to the second unit and then be recycled to the first reaction stage.

In case the sulfur content of the second stage charge is low, it may be not necessary to adequate the sulfur content of the outlet gas of the second stage to attend to the upper limit of the $H_2S$ content in the intake of the first reaction stage at 0.1% by volume.

In the same way, the $H_2S$ removal step from the outlet gas of the first stage should be efficient to a degree such that at the intake of the second reaction stage the $H_2S$ content is lower than 0.05% by volume.

The make-up of the at least one added non-reactive compound and hydrogen can be performed in just one or in both stages, or separately in one or another stage, with consequences for the operation conditions in each stage, resulting in small variations in the composition of the recycle stream in each process step, such modifications being easily determined by the experts.

In case of various compositions of $H_2$ and at least one added non-reactive compound in each reaction stage, including the case of hydrogen alone in one of the stages, the gas recycles should be independent. The $H_2S$ removal step is required in the effluents of the first reaction stage, and can be required or not in the effluents of the second reaction stage. This will mainly depend on the sulfur content of the second stage charge, so as to attend to the recommended basis of maximum $H_2S$ at the reaction stage intake.

Other process set-ups designed to attend to the preferred modes of the invention are possible and easily apparent to the experts, and do not constitute inventive matter. Thus, well known means in the art of fluid transport, product separation, $H_2S$ removal, $H_2$ and lost compounds make-up can be used to obtain the conditions required for the invention modes.

If the at least one added non-reactive compound in the vapor state under condensation conditions, downstream of the reactor, are preferably slightly soluble in the product, being kept with hydrogen in the gas recycle, and is preferably directed to a $H_2S$ absorption tower for absorbing $H_2S$ formed during the HDS reactions. Consumed hydrogen as well as non-reactive gas lost through solubilization into the product in the high-pressure separator should be replenished to allow that the recycle gas composition be kept constant and the recycle compressor work in its optimum operation condition.

The addition of the at least one non-reactive compound can be performed intermittently or continuously. Processes for carrying out a recycle do not constitute inventive matter for the experts. Concentration limits for the content of the compounds dealt with in the present invention can equally be set forth. The compounds can be added or purged so as to keep the desired concentration. A further alternative is the continuous injection and purge of the at least one added non-reactive compound, provided the means for separating hydrogen from said compounds and recycling hydrogen alone are available.

The process of the present invention, according to a preferred embodiment, is described below:

a) During an initial reaction stage, under hydrodesulfurization conditions and using a reactor charged with a hydrorefining catalyst, contact a naphtha charge with a flow of hydrogen and at least one added non-reactive compound, wherein the $H_2$ molar fraction falls within the range of 0.2 to 1, and with the $H_2S$ concentration at the reactor intake limited to not more than 0.1% by volume, to produce an effluent;

b) Remove $H_2S$ from the first-stage reaction effluent to obtain a partially hydrodesulfurized naphtha; and c) Channel the partially desulfurized naphtha from step b) to a second-stage reaction, in a reactor loaded with a second hydrorefining catalyst, under second hydrodesulfurization conditions, and contact this naphtha with a flow of hydrogen and at least one added non-reactive compound, with the $H_2$ molar fraction ranging from 0.2 to 0.7, and with the $H_2S$ concentration at the reactor intake limited to not more than 0.05% by volume, to recover a hydrodesulfurized naphtha having higher reaction selectivity than those of state of the art processes.

Accordingly, the present invention comprises a two-stage hydrodesulfurization reaction, under normal process conditions, wherein the olefinic naphtha charge contacts a hydrorefining catalyst and a flow of hydrogen and at least one added non-reactive compound, with the $H_2S$ removed between the two reaction stages. Preferably, nitrogen is used as the added non-reactive compound in the flow of hydrogen and at least one added non-reactive compound.

For every possible combination of the process of the present invention, the ratio of the volume of the flow of hydrogen and at least one added non-reactive compound to the volume of the processed charge must fall between 100 and 1,000 $Nm^3/m^3$, preferably between 200 and 800 $Nm^3/m^3$, and more preferably between 300 and 600 $Nm^3/m^3$.

It is assumed that it will be necessary to provide make-up flows of hydrogen and the at least one added non-reactive compound in order to maintain the $H_2$ molar ratio of the $H_2$ and the at least one added non-reactive compound stream and the ratio between the volume of the flow of hydrogen and the at least one added non-reactive compound by volume of the processed charge under the desired conditions for the invention. By the same token, operations involving recycling, removal of byproducts and piping of liquids found in any procedure known in the art may be used in the present invention.

At the reactor intake, in the first reaction stage, the $H_2S$ concentration is preferably less than 0.05% by volume. Levels higher than 0.1% by volume compromise the selective HDS owing to significant recombination of the $H_2S$ with the remaining olefins.

Any known method can be used to remove the $H_2S$ from the effluent from the first stage of the reaction. These methods include, but are not limited to condensation, separation, distillation, contacting the counter flowing liquid product with a gas containing no $H_2S$, rectification and absorption with a monoethanolamine/diethanolamine (MEA/DEA) solution, adsorption, membranes, and washing with an alkaline solution.

At the reactor intake, in the second reaction stage, the $H_2S$ concentration is preferably less than 0.025% by volume. Levels higher than 0.05% by volume compromise the selective HDS owing to significant recombination of the $H_2S$ with the remaining olefins.

The $H_2S$ content in the first stage feed should be lower than 1,000 ppmv, and that of the second stage, lower than 500 ppmv. Preferably, the origin of the mixture of $H_2$ and the at least one added non-reactive compound is the gas recycle plus the make-up streams, the $H_2S$ of the first stage product being necessarily removed. The recycle can have origin in the first as well as in the second reaction stage. In case it originates in the second stage and if there is no $H_2S$ removal section in the first stage, the sulfur content of the second stage charge should be such as not to lead to a $H_2S$ content higher than 1,000 ppmv in the first stage charge. Higher $H_2S$ contents in the first stage would lead to an amount of mercaptans such as to hinder the attainment of sulfur contents in the first stage product allowing to high sulfur removal in the second stage, also consequent to the recombination reaction.

In the particular case of employing the at least one added non-reactive compound in the second stage only, it is not possible to recycle gas from the second stage to the first one.

Possible set-ups for removing $H_2S$ and recycling flows are well known in the art, and should be selected from those that respond to $H_2S$ limits of more than 0.1% at the reactor intake, in the first stage of hydrodesulfurization, and 0.05% $H_2S$ at the reactor intake in the second stage of the reaction.

Preferably, the flow of hydrogen and at the least one added non-reactive compound comes from recycling the hydrodesulfurization effluent gas, or from the first or second stage, with which make-up flows of $H_2$ and the at least one added non-reactive compound are mixed. In addition, the recycling of the effluent gas from the reaction and the $H_2S$ removal step can be separate for each stage, in particular if there are different compositions of the flow of hydrogen and at the least one added non-reactive compound in each reaction stage.

Replenishment of the at least one added non-reactive compound in the flow of hydrogen and at least one added non-reactive compound increases when the latter is condensed and solubilized in the liquid effluent from hydrodesulfurization. Losses of said compound can further occur as a consequence of $H_2S$ removal steps.

When the at least one added non-reactive compound is condensed and solubilized in the liquid effluent, it can be removed by distillation or by any separation method, and can also form part of the stream of hydrodesulfurized naphtha recovered in the process, and be added without any harm to the final gasoline composition.

Preferably, the at least one added non-reactive compound is vaporized under condensation conditions, downstream from the reactor, and then mixed with hydrogen to form a recycled gas.

Some ways used for making hydrogen can lead to the at least one non-reactive compound to be added to the inventive process. The steam reform designed to obtain the charge for ammonia synthesis units yields a mixture of $N_2$ and $H_2$. It would be possible to process a make-up stream containing $N_2$ and $H_2$. However, if the unit comprises a gas recycle, the composition of the recycle gas varies depending on operation conditions of: (i) the vessels for liquid separation, (ii) the $H_2S$ removal step, resulting in solubility losses of the recycle gas flow rate, and finally (iii) the effective hydrogen consumption in the reactor, this being a function of the operation conditions themselves and being the dominant factor to hydrogen replenishing in the reactor.

The preferred condition is therefore to own independent at least one added non-reactive compound and hydrogen make-up streams. The control of the make-up flow rates is performed so as to make-up the $H_2$ consumed in the reaction and the lost added non-reactive compound so as to keep the hydrogen molar ratio in the stream of $H_2$ and the at least one added non-reactive compound, the ratio of $H_2$ and the at least one added non-reactive compound by charge and the pressure at the desired conditions.

Accordingly, the recycled gas from the first reaction stage is passed through a stage for removing the $H_2S$ before returning to the hydrodesulfurization reactor, in order to adjust the $H_2S$ concentration to a level of less than 0.1% by volume.

The means for removing $H_2S$ from the recycled gas may include, albeit not limited to, absorption units using diethanolamine (DEA) or monoethanolamine (MEA), and washing with an alkaline solution.

In the case of a recycled gas coming from the second hydrodesulfurization stage, when there is no $H_2S$ removal area, the concentration of the organosulfurized compounds in the second reaction stage must be such that it does not lead to an increase in $H_2S$ concentration greater than 0.1% by volume at the reactor intake in the first reaction stage, or 0.05% by volume at the reactor intake in the second reaction stage.

Moreover, it is known that a high concentration of $H_2S$ present in the reaction mixture causes recombination of the $H_2S$ with the remaining olefins, forming mercaptanic compounds. Accordingly, during the second reaction stage, it would be possible to use only at least one added non-reactive compound to promote the conversion of part of these mercaptanic compounds, though not the conversion of the thiophenic compounds, which are still present and which depend on hydrogenation for their conversion.

The following: (a) heat-exchange methods that raise the temperature of the flow of hydrogen and at least one added non-reactive compound to reaction conditions; (b) methods that facilitate the piping of the reaction mixture to the hydrodesulfurization reactor; (c) methods for separating gas and liquid products; (d) methods for removing $H_2S$ from gas and liquid flows; (e) methods for recycling flows of $H_2$ and at least one added non-reactive compound for the reaction stages; and (f) methods for maintaining the molar fraction of hydrogen and the ratio of the volume of hydrogen and at least one added non-reactive compound to charge volume at the desired values for the present invention.

Without limiting the claims for the present invention to a mechanism for decreasing the recombination of olefins, it is believed that in addition to reducing the concentration of $H_2S$ in the second reaction stage, thus hindering the recombination reactions, the presence of at least one added non-reactive compound decreases the hydrogen concentration, thereby blocking the undesired olefin hydrogenation reactions, without increasing, and preferably, decreasing the $H_2S$ concentration.

It is believed that a higher hydrogen concentration in the first stage leads to more easily desulfurizable species in the second reactor. The use of the at least one added non-reactive compound is mandatory in the second reactor. Hydrogen consumed in the reaction should be made-up, as well as the at least one added non-reactive compound lost by solubilization in the product in some of the process steps, so as to keep the gas/charge ratios described in steps a) and b), as well as the $H_2/(H_2$+added non-reactive compound) under desired conditions.

Finally hydrodesulfurized naphtha is obtained, having low sulfur content (preferably lower than 100 ppm) and a low olefin hydrogenation degree, (preferably lower than 40% of the charge original olefins, more preferably, lower than 30% of the original olefins.)

To illustrate the application of the present invention, the degrees of conversion of organosulfurized compounds as well as the hydrogenation of the olefins, both of which are present in the charge of olefinic naphtha flows, is expressed by the results in the following Examples and figures.

Other interpretations of the nature and mechanism for increasing selectivity have no effect on the novelty of the present invention, which will now be illustrated by the following Examples, not to be considered as limitative.

EXAMPLES

For the following examples, a charge of an olefinic naphtha from the catalytic cracking of gasoline was used, without subsequent fractionating, with the following characteristics: sulfur, 1,689 mg/kg; olefins, 27.0 mass %; and specific gravity, 0.7598.

The naphtha charge was processed in an isothermal hydrodesulfurization reactor, by means of controlled heating zones, loaded with 150 mL of a commercial catalyst diluted in 150 mL of carborundum.

A CoMo commercial catalyst (4.4% CoO and 17.1% $MoO_3$) was used. This catalyst was supported on trilobe $Al_2O_3$, having a diameter of 1.3 mm. The catalyst was sulfided beforehand and stabilized with a directly distilled naphtha prior to processing the olefinic naphtha charge.

The following process parameters were kept fixed in the reactor: ratio of gas volume (hydrogen or a mixture of hydrogen and nitrogen) to charge volume of 320 $Nm^3/m^3$, space velocity of 4 $h^{-1}$ (hourly charge volume per catalyst volume), and a pressure of 2.0 MPaG.

For the purposes of comparison, the following are the results for process parameters: temperature ranging from 240 to 280° C. and $H_2$ molar fraction of 1.0 and 0.5 in the flow of hydrogen and at least one added non-reactive compound.

In addition to the two-stage testing, tests were also conducted in a single stage, without removing the $H_2S$ and with LHSV of 2 $h^{-1}$, equal to the sum of the LHSV for both reaction stages.

Lastly, the results in two stages and in one stage, in the presence of a hydrogen and nitrogen flow, were compared to the results obtained in one and two stages with hydrogen alone.

Example 1

This example pertains to the state of the art. Hydrodesulfurization is carried out by contacting the naphtha charge with the catalyst and hydrogen gas, in two reaction stages.

The charge was processed in the first stage using a pure hydrogen flow and at a temperature controlled at 255° C. alongside the reactor, with the other conditions fixed as described above.

Upon removing the $H_2S$ from the effluent, the sulfur concentration was 170 mg/kg, and the olefin concentration was 22.3 mass % in the partially hydrodesulfurized naphtha, equal to a 17.4% hydrogenation of olefins.

Analysis of sulfur speciation showed that only 17% of the sulfur in the partially hydrodesulfurized naphtha corresponds to thiophenic compounds present in the charge, while the remaining 83% are likely mercaptan and sulfide compounds resulting from recombination.

Next, the partially hydrodesulfurized naphtha was submitted to a second reaction stage under the same process conditions.

Table 1 shows the results of the sulfur and olefin concentrations obtained in tests on the recovered hydrodesulfurized naphtha.

TABLE 1

| | Temperature ° C. | Molar fraction $H_2$ | Sulfur mg/kg | Olefins mass % |
|---|---|---|---|---|
| Test 1 | 240 | 1.0 | 18 | 19.1 |
| Test 2 | 260 | 1.0 | 10 | 14.0 |
| Test 3 | 280 | 1.0 | 4 | 9.2 |

Example 2

This Example regards the process of the present invention. The hydrodesulfurization reaction is carried out in two stages, using a flow of hydrogen and an added non-reactive compound (nitrogen) only in the second stage.

The naphtha charge was processed in the first stage using a pure hydrogen flow and at a temperature controlled at 255° C. alongside the reactor, with the other conditions fixed as described above.

After the $H_2S$ was removed from the partially hydrodesulfurized naphtha, the sulfur concentration was 170 ppm, and the olefin concentration was 22.3 mass %, equal to 17.4% hydrogenation of olefins.

Next, the partially hydrodesulfurized naphtha was submitted to a second reaction stage wherein the $H_2$ molar fraction was kept at 0.5 while varying the reaction temperature.

Table 2 shows the results for the sulfur and olefin concentrations obtained during testing.

TABLE 2

| | Temperature ° C. | Molar fraction $H_2$ | Sulfur mg/kg | Olefins mass % |
|---|---|---|---|---|
| Test 1a | 240 | 0.5 | 22 | 20.6 |
| Test 2a | 260 | 0.5 | 12 | 19.0 |
| Test 3a | 280 | 0.5 | 6 | 16.4 |

Example 3

This Example regards the process wherein the hydrodesulfurization reaction is carried out in two stages, using a flow of hydrogen and an added non-reactive compound (nitrogen) only in the first stage.

The naphtha charge was processed in the first stage using an equimolar mixture of $N_2$ and $H_2$ and at a temperature controlled at 272° C. alongside the reactor, holding to the same sulfur content as in EXAMPLES 1 and 2, and with the other conditions fixed as described above. Thus, the sulfur content of the first stage products in the hydrodesulfurization with $H_2$ (EXAMPLE 1 and 2) and EXAMPLE 3 can be considered as equivalents.

After the $H_2S$ was removed from the partially hydrodesulfurized naphtha, the sulfur concentration was 165 mg/kg, and the olefin concentration was 22.5 mass %, equal to 16.9% hydrogenation of olefins.

Analysis of sulfur speciation showed that 45% by mass of the sulfur in the partially hydrodesulfurized naphtha corresponds to the species present in the charge, while the remaining 55% by mass are likely mercaptan and sulfide compounds resulting from conversion or from partially hydrogenated thiophenic compounds.

Next, the partially hydrodesulfurized naphtha was submitted to a second hydrodesulfurization reaction stage using only $H_2$ gas, while varying the reaction temperature.

Table 3 shows the results for the sulfur and olefin concentrations obtained during testing.

TABLE 3

| | Temperature ° C. | Molar fraction $H_2$ | Sulfur mg/kg | Olefins % m/m |
|---|---|---|---|---|
| Test 1b | 240 | 1.0 | 19 | 19.3 |
| Test 2b | 260 | 1.0 | 10 | 16.3 |
| Test 3b | 280 | 1.0 | 4 | 11.8 |

Example 4

This Example regards the process of the present invention wherein the hydrodesulfurization reaction is carried out in two stages, using a flow of hydrogen and added non-reactive compound (nitrogen) in both stages.

The charge was processed in the first stage using an equimolar mixture of $N_2$ and $H_2$ and at a temperature controlled at 272° C. alongside the reactor, and with the other conditions fixed as described above.

After the $H_2S$ was removed from the partially hydrodesulfurized naphtha, the sulfur concentration was 165 mg/kg, and the olefin concentration was 22.5% m/m, equal to 16.9% hydrogenation of olefins.

Next, the partially hydrodesulfurized naphtha was submitted to a second reaction stage using a flow of hydrogen and added non-reactive compound (nitrogen) with a molar fraction of 0.5 $H_2$, while varying the reaction temperature.

Table 4 shows the results for sulfur and olefin concentrations obtained during testing.

TABLE 4

| | Temperature ° C. | Molar fraction $H_2$ | Sulfur mg/kg | Olefins % m/m |
|---|---|---|---|---|
| Test 1c | 240 | 0.5 | 29 | 20.9 |
| Test 2c | 260 | 0.5 | 14 | 19.2 |
| Test 3c | 280 | 0.5 | 6 | 16.6 |

By comparing the results of EXAMPLES 1-4, it can be seen that the use of the flow of hydrogen and a non-reactive compound in both reaction stages, or in only the second stage, results in less hydrogenation of olefins and greater selectivity for the same degree of hydrodesulfurization. Use of only hydrogen in both stages (EXAMPLE 1, state of the art) results in greater hydrogenation of olefins and lesser selectivity for a given conversion of organosulfurized compounds.

Example 5

This comparative Example regards the state of art. Hydrodesulfurization reaction is carried out in one stage, using a flow of hydrogen and an added non-reactive compound. An LHSV of 2 $h^{-1}$ was used for single-stage testing, equal to the LHSV in the two-stage reaction in EXAMPLES 1 to 4.

TABLE 5

| | Temperature ° C. | Molar fraction $H_2$ | Sulfur mg/kg | Olefins mass % |
|---|---|---|---|---|
| Test A | 270 | 1.0 | 55 | 11.3 |
| Test B | 290 | 1.0 | 13 | 4.5 |
| Test C | 270 | 0.5 | 88 | 18.5 |
| Test D | 290 | 0.5 | 35 | 12.6 |
| Test E | 310 | 0.5 | 11 | 6.8 |

Figure 2:
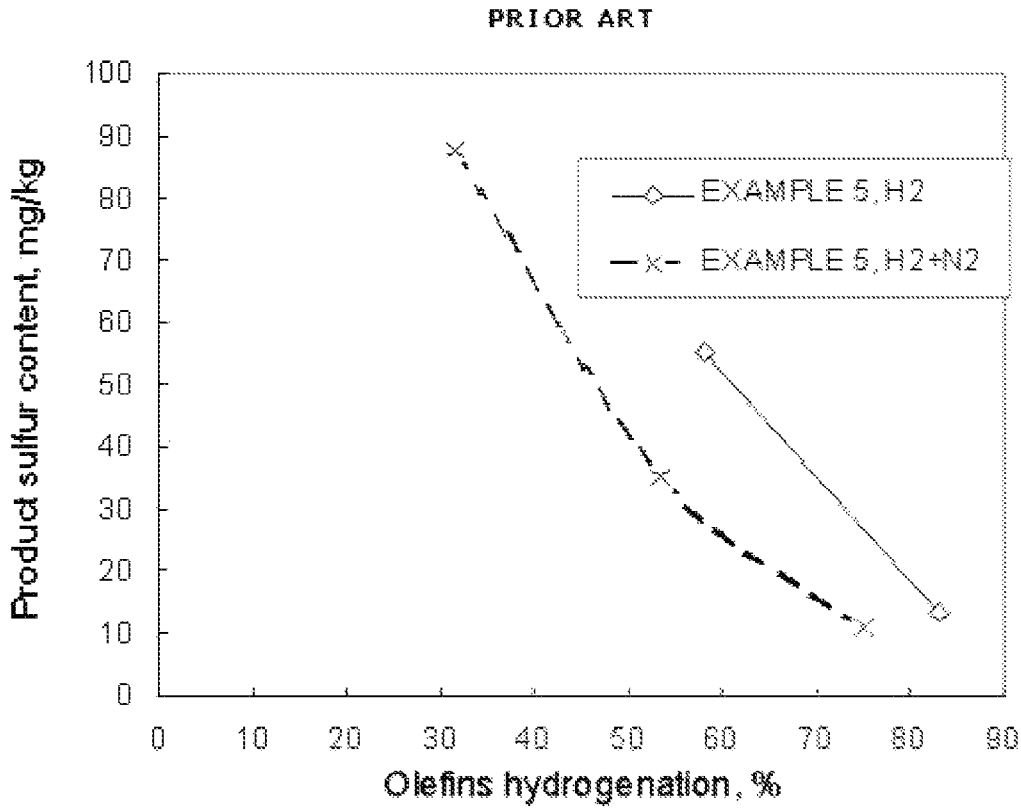
FIG. 2 illustrates the state of art of a single-stage process for a hydrodesulfurization reaction involving a naphtha charge, in accordance with EXAMPLE 5, with and without nitrogen mixed with hydrogen.

Comparison of FIGS. 1 and 2 shows that the use of both HDS reaction stages leads to greater selectivity than does one reaction stage. It can be seen that in a one-stage reaction, in order to reach the sulfur content attained in a two-stage reaction, e.g., less than 30 mg/kg, higher severity is required, which results in greater olefin hydrogenation.

FIG. 1 is a comparison of Examples 1 to 4. In these Examples, the temperature conditions for the first stage for pure hydrogen as well as for the hydrogen and nitrogen flow, were set forth to obtain the same level of the sulfur content of the first stage product. First-stage sulfur contents of 170 mg/kg in EXAMPLES 1 and 2 (with pure $H_2$) and of 165 mg/kg in EXAMPLES 3 and 4 (with hydrogen and nitrogen) can be considered to be equal. A lower temperature (255° C.) was required in the HDS with pure hydrogen to reach the same level of HDS using the hydrogen and nitrogen flow at 272° C.

An equal sulfur content in the second-stage reaction charge made it possible to obtain the same maximum partial pressure for $H_2S$ at the reactor outtake, and the same potential for recombining $H_2S$ with the olefins. In contrast, different sulfur content in the charges could mask the effect of the added non-reactive compound. Thus the same sulfur content in the second-stage charge allows for a comparison of the effect of using the added non-reactive compound on process selectivity.

The graph in FIG. 1 shows that the HDS in two reaction stages using pure $H_2$ (EXAMPLE 1, state of the art) was the least selective. A similar result was attained in EXAMPLE 3, where pure hydrogen was used only in the second reaction stage.

EXAMPLES 2 and 4, using a hydrogen and nitrogen flow in the second reaction stage and in both stages, clearly provided better selectivity for HDS, i.e., the same sulfur contents with less olefin hydrogenation.

EXAMPLES 2 and 4 show that in the present invention, when a mixture of $H_2$ and at least one added non-reactive compound is used under desired conditions in both reaction stages or only the second stage, it is possible to obtain a selectivity level heretofore not attained in the state of the art, represented by EXAMPLES 1 and 5.

Comparison of EXAMPLES 2 and 4 shows greater selectivity for hydrogenation using a hydrogen and nitrogen flow only in the second reaction stage.

Without limiting the scope of the present invention to a hypothetical effect of nitrogen on selectivity, it is believed that for the same sulfur content in the first stage of hydrodesulfurization using only pure hydrogen, sulfur is present in its mercaptanic form. One HDS route for thiophenic species can involve ring hydrogenation, occurring more extensively with a higher hydrogen concentration.

During the first stage of HDS with hydrogen alone, a lower temperature is required, and the mercaptanic sulfur content is higher and the thiophenic sulfur content is lower, inasmuch as conversion of thiophenic compounds depends on the partial pressure of hydrogen while recombination is favored at low temperatures. For the same level of HDS, using a flow of hydrogen and at least one added non-reactive compound, the required temperature is higher, the $H_2S$ recombination is lower, while the (more refractory) thiophenic sulfur content is higher. Analyses of sulfur speciation for the first-stage products generated in EXAMPLES 1 to 4 concur with a lower mercaptanic sulfur content in hydrotreatment using the flow of hydrogen and at least one added non-reactive compound, and a higher mercaptan content in HDS using a pure hydrogen flow.

In the second stage, the mercaptan species are more readily hydrodesulfurized than the thiophenic type. And, with the flow of hydrogen and at least one added non-reactive compound it is possible to achieve the same final level of HDS, with less olefin hydrogenation. This explains the greater selectivity of EXAMPLE 2 in comparison to EXAMPLE 4, and of both in comparison to EXAMPLE 3.

Thus, without limiting the scope of the present application, it is believed that for the same sulfur content, in the HDS of the first stage containing hydrogen alone, in spite of the lower selectivity, the sulfur is of a more mercaptan nature. One of the HDS routes of the thiophenic species can involve ring hydrogenation, and with more hydrogen available, it can occur more extensively.

For fixed LHSV, pressure and gas/charge ratio, it is assumed that for the same HDS level, with hydrogen alone, it is possible to operate at lower temperatures, the sulfur recombination is more favored and the content of thiophenic sulfur is lower, since the conversion of thiophenic compounds depends on the hydrogen partial pressure.

For the same HDS level, using a mixture of $H_2$ and at least one added non-reactive compound the temperature is higher, the sulfur recombination is less, and less olefins are hydrogenated, but the content of (more refractory) thiophenic sulfur is higher. Sulfur speciation tests set forth in Examples 2 and 4 (first stage products) agree with lower mercaptan sulfur contents in the HDS with an atmosphere containing at least one added non-reactive compound.

In the second stage, the mercaptan species are more easily converted than the thiophenic ones. Still, having the added non-reactive compound mixed to the hydrogen, it is possible to attain the same level of final HDS, at lower olefin hydrogenation. Therefore it would be important to have more easily desulfurizable compounds for the second HDS stage.

In the first stage treatment under a hydrogen atmosphere is possible to obtain sulfur contents lower than 300 ppm, preferably lower than 200 ppm and a low degree of olefin hydrogenation (<20), with most of the remaining sulfur compounds being mercaptans.

The present invention, directed to the hydrodesulfurization of cracked naphthas in two stages, with the intermediate $H_2S$ removal and final treatment under a hydrogen atmosphere and at least one added non-reactive compound, leads to a selectivity level not yet reached in the technique.

The above considerations and Examples demonstrate therefore that the present invention, directed to the use of at least one added non-reactive compound in at least the second stage of an HDS process, after the intermediate $H_2S$, implies in better reaction selectivity.

While the invention has been described in detail and with reference to specific examples thereof, it will be apparent to one skilled in the art that various changes and modifications can be made therein without departing from the spirit and scope thereof.

This application is based on Brazilian patent application Number PI 0404951-9, filed on Nov. 10, 2004, the entire disclosure of which is incorporated herein by reference, as if fully set forth.

What is claimed is:

1. A process for selective hydrodesulfurization of a naphtha charge containing olefins and organosulfur compounds, comprising the following steps:

a) under hydrodesulfurization conditions, contacting the naphtha charge, in a first reactor charged with a hydrorefining catalyst, with a flow of hydrogencontaining a controlled admixture of at least one non-reactive compound, wherein the $H_2$ molar fraction in said flow ranges up to 1.0 and the $H_2S$ concentration at the reactor intake is limited to a maximum of 0.1% by volume to produce an effluent;

b) removing $H_2S$ from the effluent of step a) to obtain a partially hydrodesulfurized naphtha;

c) channeling the partially hydrodesulfurized naphtha obtained in step b) to a second reaction stage, using a reactor charged with a second hydrorefining catalyst, under similar hydrodesulfurization conditions as those in the first reactor, and contacting the partially desulfurized naphtha in the second reaction stage with a flow of hydrogen containing a controlled admixture of at least one non-reactive compound, wherein the molar fraction of $H_2$ in said flow ranges between 0.2 and 0.5 and the $H_2S$ concentration at the reactor intake is limited to a maximum of 0.05% by volume, and d) recovering a hydrodesulfurized naphtha while inhibiting olefin hydrogenation in such a way that the $H_2$ molar fraction in the first reactor is higher than the $H_2$ molar fraction in the second reactor.

2. The process for selective hydrodesulfurization of claim 1, wherein in the first hydrodesulfurization stage the molar ratio of hydrogen in the mixture of hydrogen and the at least one added non-reactive compound is 1.0 and in the second hydrodesulfurization stage said molar ratio is between 0.3 and 0.6.

3. The process for selective hydrodesulfurization of claim 1, wherein the recovered hydrodesulfurized naphtha comprises less than 10% of sulfur contained in the naphtha charge and 60% or more by mass of the olefins contained in the naphtha charge.

4. The process for selective hydrodesulfurization of claim 1, wherein the hydrodesulfurization conditions comprise a temperature ranging from 200 to 420° C.; a pressure ranging from 0.5 to 5.0 MPaG; and a space velocity (LHSV) from 1 to 20 $h^{-1}$.

5. The process for selective hydrodesulfurization of claim 1, wherein the naphtha charge contains the olefins at a concentration ranging from 20 to 50% by mass and sulfur at a concentration of from 300 to 7,000 mg/kg.

6. The process for selective hydrodesulfurization of claim 5, wherein the naphtha charge contains the olefins at a concentration ranging from 25 to 35% by mass and sulfur at a concentration of from 1,000 to 1,500 mg/kg.

7. The process for selective hydrodesulfurization of any one of claims 5 and 6, wherein the naphtha charge comprises a distillation fraction of an FCC naphtha.

8. The process for selective hydrodesulfurization of any one of claims 5 and 6, wherein the naphtha charge is pretreated by a process for hydrogenating only dienes present in the naphtha charge.

9. The process for selective hydrodesulfurization of claim 1, wherein the at least one added non-reactive compound is selected from the group consisting of noble gases, saturated $C_1$ to $C_4$ hydrocarbons, and mixtures thereof.

10. The process for selective hydrodesulfurization of claim 1, wherein the at least one added non-reactive compound comprises nitrogen.

11. The process for selective hydrodesulfurization of claim 1, wherein the flow of hydrogen and at least one added non-reactive compound is admitted at a ratio per volume of the processed naphtha charge of 100 to 1,000 $Nm^3/m^3$, in the first and second reaction stages.

12. The process for selective hydrodesulfurization of claim 11, wherein the flow of hydrogen and at least one added non-reactive compound is admitted at a ratio per volume of the processed naphtha charge of 200 to 800 $Nm^3/m^3$, in the first and second reaction stages.

13. The process for selective hydrodesulfurization of claim 12, wherein the flow of hydrogen and at least one added non-reactive compound is admitted at a ratio per volume of the processed naphtha charge of 300 to 600 $Nm^3/m^3$, in the first and second reaction stages.

14. The process for selective hydrodesulfurization of claim 1, wherein the $H_2S$ concentration at the reactor intake is limited to not more than 0.05% by volume in the first reaction stage.

15. The process for selective hydrodesulfurization of claim 1, wherein the $H_2S$ concentration at the reactor intake is limited to not more than 0.025% by volume in the second reaction stage.

16. The process for selective hydrodesulfurization of claim 1, wherein the $H_2S$ in the first reaction stage effluent is removed by a method selected from the group consisting of condensation, separation, distillation, contacting a counterflowing liquid product with a gas containing no $H_2S$, rectification and absorption with an MEA/DEA solution, adsorption, membranes, and washing with an alkaline solution.

17. The process for selective hydrodesulfurization of claim 4, wherein the hydrodesulfurization is carried out under a temperature ranging from 240 to 380° C.

18. The process for selective hydrodesulfurization of claim 17, wherein the hydrodesulfurization is carried out under a temperature ranging from 260 to 320° C.

19. The process for selective hydrodesulfurization of claim 4, wherein the hydrodesulfurization is carried out under a pressure ranging from 1.0 to 3.0 MPaG.

20. The process for selective hydrodesulfurization of claim 19, wherein the hydrodesulfurization is carried out under a pressure ranging from 1.5 to 2.5 MPaG.

21. The process for selective hydrodesulfurization of claim 1, wherein the hydrorefining catalyst of each reaction stage contains metals from Groups VIB and VIII of the Periodic Table of the Elements.

22. The process for selective hydrodesulfurization of claim 21, wherein the hydrorefining catalyst contains metals Ni or Co and Mo or W.

23. The selective hydrodesulfurization process of claim 22, wherein the hydrorefining catalyst contains CoO and $MoO_3$ prior to sulfiding.

24. The process for selective hydrodesulfurization of claim 23, wherein the metals are in their oxide forms and on an alumina support.

25. The process for selective hydrodesulfurization of claim 21, wherein the contents of metals of the Group VIB and/or VIII as oxides on the catalytic support is in the range of 5 to 30% by mass.

26. The process for selective hydrodesulfurization of claim 21, wherein the metals are in their oxide form and supported by a support having low intrinsic acidity.

27. The process for selective hydrodesulfurization of claim 26, wherein the support comprises mixed oxides of $Al_2O_3$ and MgO to decrease the intrinsic acidity of the support.

28. The process for selective hydrodesulfurization of claim 26, wherein the support comprises Group I alkaline metal compounds and/or alkaline-earth metals from Group II of the Periodic Table deposited thereon in a concentration ranging from 0.05 to 20% by mass to decrease the intrinsic acidity of the support.

29. The process for selective hydrodesulfurization of claim 21, wherein the hydrorefining catalyst is deactivated owing to prior use in a hydrorefining unit.

* * * * *